US005999080A

United States Patent [19]

Furino, Jr.

[11] Patent Number: 5,999,080

[45] Date of Patent: Dec. 7, 1999

[54] FREQUENCY DEPENDENT RESISTIVE ELEMENT

[75] Inventor: James P. Furino, Jr., Melbourne, Fla.

[73] Assignee: Intersil Corporation, Palm Bay, Fla.

[21] Appl. No.: 09/246,815

[22] Filed: Feb. 9, 1999

Related U.S. Application Data

[62] Division of application No. 08/941,704, Oct. 10, 1997, Pat. No. 5,883,565.

[51] Int. Cl.[6] ..... H01C 8/02

[52] U.S. Cl. ..... 338/1; 338/216; 338/217; 338/307; 338/333; 333/81 R

[58] Field of Search ..... 338/307, 311, 338/252, 1, 60, 61, 51, 333, 216, 217

[56] References Cited

U.S. PATENT DOCUMENTS

| | | | |
|---|---|---|---|
| 543,800 | 7/1895 | Davis | 338/252 |
| 1,506,224 | 8/1924 | Becker | 338/333 |
| 2,169,594 | 8/1939 | Schellenger | 338/333 |
| 3,059,201 | 10/1962 | Saad | 338/216 |
| 4,586,018 | 4/1986 | Bettman | 338/42 |
| 4,855,571 | 8/1989 | Ting et al. | 338/333 |
| 5,889,261 | 3/1999 | Boardman | 338/307 |

FOREIGN PATENT DOCUMENTS

| | | | |
|---|---|---|---|
| 671479 | 8/1989 | Switzerland | 338/1 |

*Primary Examiner*—Lincoln Donovan
*Assistant Examiner*—Karl Easthom
*Attorney, Agent, or Firm*—Rogers & Killeen

[57] ABSTRACT

A frequency dependent resistor in which the length of the current path across the resistor varies as a function of the frequency of the electrical signals being passed therethrough. The resistor uses the principal known as skin effect to direct relatively higher frequency signals through a longer path through the resistor than is experienced by signals having a relatively low frequency.

9 Claims, 4 Drawing Sheets

SIDE VIEW CROSSECTION

FREQUENCY DEPENDENT RESISTIVE ELEMENT

CROSS-REFERENCE TO RELATED APPLICATION

This is a divisional application of application Ser. No. 08/941,704, filed Oct. 10, 1997, now U.S. Pat. No. 5,883, 565.

BACKGROUND OF THE INVENTION

The present invention is directed generally to circuits and elements for managing electrical signals and, in particular, to circuits and elements for applying a variable resistance to electrical signals passing therethrough.

In managing and operating electrical signals (which may include radio frequency ("RF") signals), it is frequently desirable to vary the resistance applied to such signals based upon the frequency of the signals. To provide for such varying resistance, the prior art is replete with circuits for varying the resistance of a portion of a circuit in response to a detected frequency of a signal being carried. For example, it is known in the prior art to utilize a subcircuit in which plural resistors are interconnected by switches so that electrical signals can be passed from one end of the subcircuit to the other end while experiencing different amounts of resistance, depending upon the switch settings which, in turn, change the amount of resistance placed in the path between the ends of the subcircuit. The resistors can be switched into and out of the subcircuit in a parallel or serial fashion to provide a wide variety of resistance choices for the differing signals passing therethrough. As is known in the art, the operation of the switches may be made dependent on the frequency of the passing signal as detected by a conventional frequency detector. The use of such frequency varying resistance devices is relatively complex, given the number of switches which may be involved and the complexity of a reliable frequency determination circuit. Such devices, therefor, add both to the complexity and cost of a circuit wherein they are used. In addition, such devices may diminish the overall reliability of the circuit in which they are used.

There are also many different devices and circuits in the prior art in which the resistance of the device/circuit varies as a function of the frequency of signals being passed therethrough. Many of such devices use inductive and/or capacitive elements which permit the circuit to respond variably to frequency but which often place a lag in the signal being passed therethrough and may generate harmonic or similar undesired signals.

In one prior art circuit, a filter in a bridge configuration utilized a Whetstone bridge in which the resistive elements were composed of a metal conductor coated with a second metal. As the frequency of the signals being passed through the resistive elements was increased, the "skin effect" caused the current to change the path of its flow from the central conductor to the second metal coating on the "skin" of the element. Thus, as the frequency of the current increased, the current experienced a variation in the resistance experienced as the current flowed first through one type of metal (the metal of the conductor) and then to a second type of metal (the metal of the coating). See, for example, the Schlachter U.S. Pat. No. 3,704,434, issued Nov. 28, 1972.

Accordingly, it is an object of the present invention to provide a novel element and circuit in which the resistance of the element or circuit varies with the frequency of the signal being passed therethrough.

It is another object of the present invention to provide a novel element and circuit having a frequency dependent resistance which does not require an active frequency determination.

It is yet another object of the present invention to provide a novel element and circuit having a frequency dependent resistance which does not require the switching among different elements.

It is still another object of the present invention to provide a novel element and circuit having a frequency dependant resistance which does not require different materials be used in the current carrying portions of the element.

It is a further object of the present invention to provide a novel element and circuit having a frequency varying resistance in which the shape of the element determines its varying resistance characteristics.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

The physics of the "skin effect" are known in the prior art; however, the use of the skin effect as contemplated by the present invention are both novel and provide a varying resistance over frequency. When an alternating current is passed through an electrical conductor of usual shape (i.e., cylindrical), the alternating magnetic flux which is generated by the alternating current produces an electromotive force ("emf") which is greatest at the center of the conductor and decreases toward the outer skin. This induced emf causes the current density of a current passing therethrough to be greater at the surface of the "usual" conductor and to decrease toward the center. As the frequency of the signal passing therethrough is increased, the current in the conductor becomes increasingly concentrated toward the outer skin. This phenomenon is known as the "skin effect."

As is known, the amplitude of the current fields in a conductor decay by an amount of 1/e or approximately 37% after traveling a distance of 1 skin depth$_{\delta s}$ interiorly into the conductor. In other words, skin depth can be defined as the distance measured inwardly from the surface of the conductor in which the current in the conductor will decrease 1 neper, i.e., the current density become 1/e times the density at the surface of the conductor where "e" is the natural logarithm base. The skin depth is given by the formula:

$$\delta_s = \sqrt{\frac{2}{\omega \times \mu \times \sigma}}$$

where ω is the radian frequency of the signal, $\mu$ is the material permeability, and, σ is the material conductivity.

For example, for aluminum at a signal having a frequency of 10 Ghz, the skin depth $\delta_s$ equals 0.814 $\mu$meters.

The present invention uses the skin effect to particular advantage by forcing the amount of skin to be traversed by an electrical signal to vary with respect to frequency, higher frequency signals having to traverse longer paths.

Figure 1:
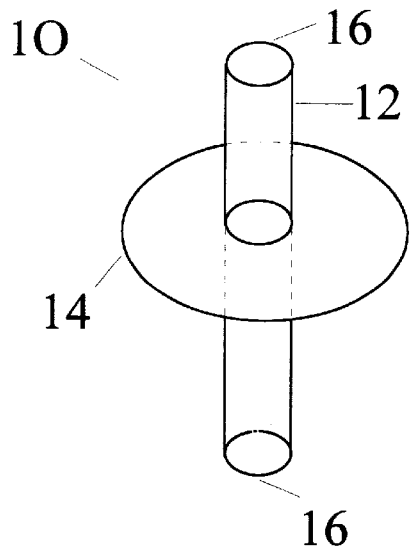
FIG. 1 is a pictorial diagram of an element in accordance with the present invention.

With reference to FIG. 1, an element 10 in accordance with the present invention may include a rod 12 and a disk 14. The disk 14 may be affixed coaxially to the rod 12. The ends of the rod 16 may be formed or treated so as to make electrical contact with electrical connectors (not shown) in any conventional fashion. The electrical connectors carry an electrical signal to and from the element 10. The materials used in the rod 12 and the disk 14 may be any suitable to provide the desired resistance characteristics. In a preferred embodiment, the rod 12 and the disk 14 may be of the same material and may be formed in a unitary structure.

The material forming the element may be any material capable of conveying electrical current. The material may be a conventional resistor material. Likewise, the material may be a conventional conductor material such as copper, aluminum, alloys thereof, and similar elements and compounds. Indeed, in many high frequency applications, conductive material, rather than conventional resistor material will usually be used. Thus, when the term "resistive material" or the like is used herein, the present invention contemplates the use of any electrically conductive material which resists the flow of electrical current therethrough. By the proper selection of material, device size and device shape as taught in the present application, a device having the desired frequency dependant resistance may be constructed by those of normal skill in the art.

Figure 2:
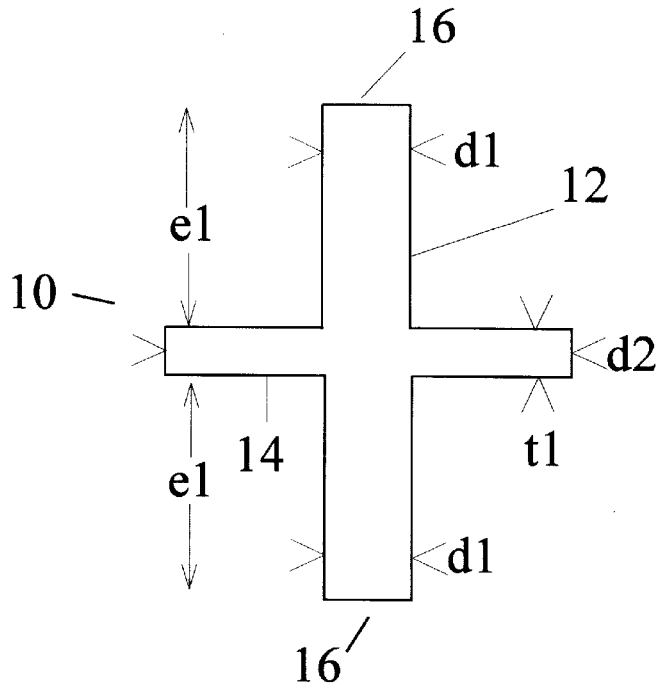
FIG. 2 is a side view of the element of FIG. 1.

With reference to FIG. 2, a side view of the element 10 in FIG. 1, the element 10 may be dimensioned as indicated with the rod 12 having a diameter d1 throughout its length. The disk 14 may have a diameter d2 and a thickness t1.

In operation, an alternating current may be passed through the element 10 by appropriately connecting an electrical circuit at the ends 16. For ac currents such that t1<2×$_{\delta s}$, the current will flow primarily through the center of the disk. For ac currents such that t1>2×$_{\delta s}$, the current flow will primarily follow the skin (or periphery) of the element.

Electrical resistance may be calculated from the formula:

$$R=\rho \times L/A \times 1/\sigma \times L/A$$

where ρ=the resistivity of the material;

σ=the conductivity of the material;

L=the length of the element; and,

A=the cross-sectional area through which the current flows.

For the rods:

$$R = \frac{1}{\sigma}(l1 + l1)\frac{1}{\pi\left[(d1/2)^2 - \left(\frac{d1 - 2\delta_s}{2}\right)^2\right]}$$

Thus, by using a material with known properties, ac currents having a frequency below a desired value will pass primarily from one end 16 to the other end 16 by passing primarily through the center of the element, i.e., through the rod 12 and will experience a resistance determined by the length of the rod, the resistivity of the material essentially unvarying. Such signals will experience the resistance caused substantially by the path length of 2×11 (the length of the rod) plus t1 (the thickness of the disk). AC currents having a frequency greater than the desired value will pass from one end 16 to the other end 16 primarily through a path adjacent the surface of the element, including the surface of the disk. In other words, the signal will experience a path of approximate length 2×11 plus d2 plus t1. Note that this signal experiences a length of resistance of d2 more than the lower frequency signal discussed immediately above.

Figure 3:
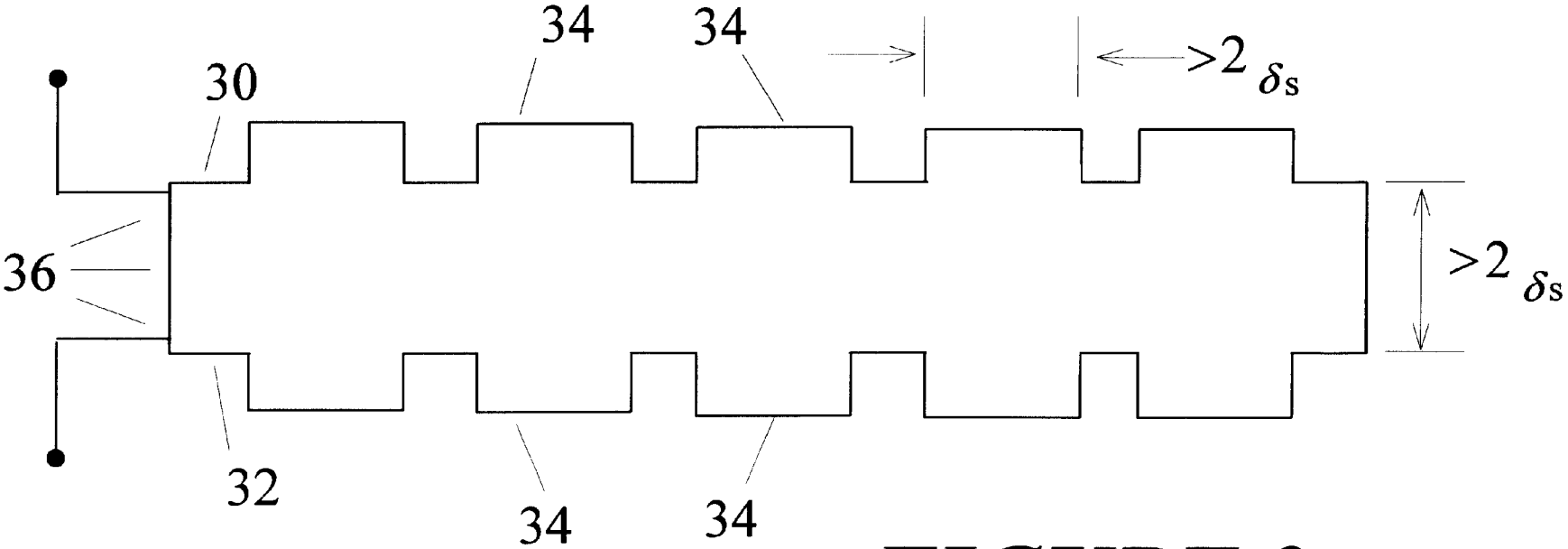
FIG. 3 is a cross sectional diagram of another embodiment of the present invention.
Figure 4:
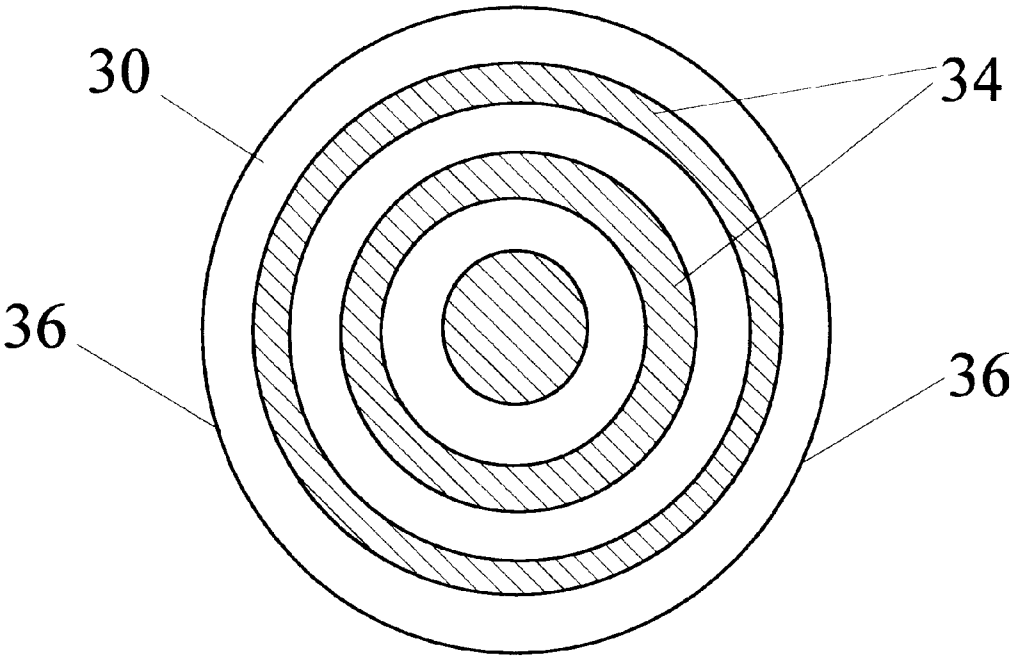
FIG. 4 is a top pictorial view of the embodiment of the present invention shown in FIG. 3.

With reference now to FIGS. 3 and 4, another embodiment of the present invention may utilize a disk which has a thickness greater than 2 skin depths ($2_{\delta s}$) and having major surfaces 30 and 32 which bear a series of embossments 34 having a width of at least 2 skin depths ($2_{\delta s}$). The lateral edge of the disk may have plural means comprising one or more terminals 36 for facile connection to an electrical conductor carrying an AC signal.

With continued reference to FIGS. 3 and 4, the embossments 34 of the disk may be fashioned in any conventional fashion, such as by etching, cutting, or dimpling. While the disk and its embossments are a unitary structure in a preferred embodiments, other materials could be used for the embossments than used in the rest of the disk to enhance the differences in resistance experienced by varying frequency AC signals carried through the disk. Still other methods could also be used to increase the resistance of the embossed portion of the disk, such as roughening the surface of the embossments is either a regular or random fashion.

Figure 5:
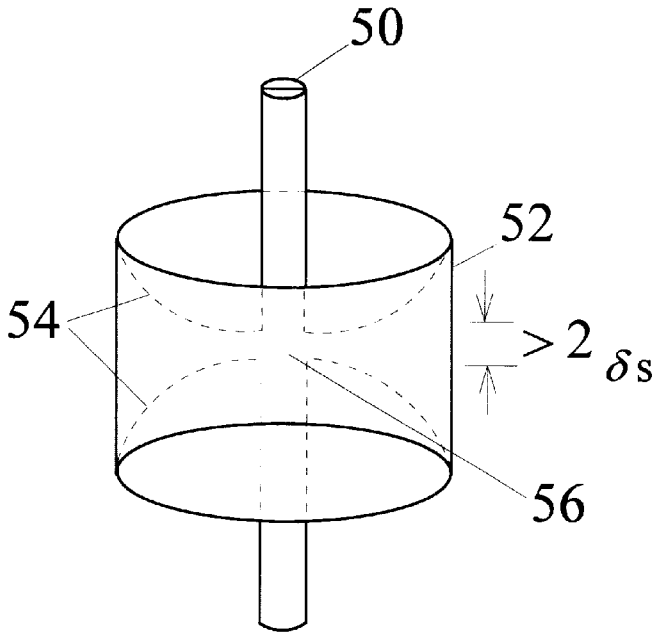
FIG. 5 is a pictorial diagram of another embodiment of the present invention; and, FIG. 6 is a cross sectional diagram of the embodiment of the present invention shown in FIG. 5.
Figure 6:
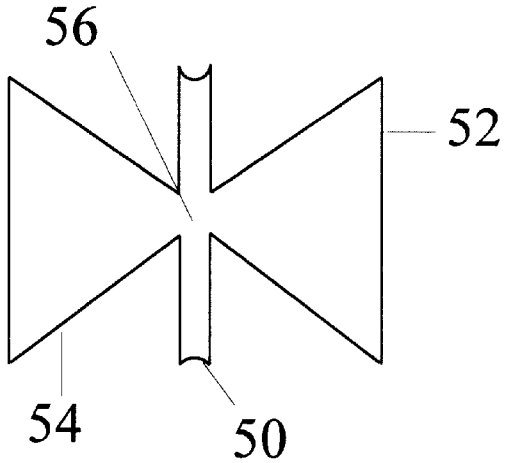

With reference to FIGS. 5 and 6, another embodiment of the present invention may include a rod 50 having a cylinder 52 coaxially affixed thereto. The cylinder 52 has cone-shaped openings 54 concave-inwardly from each of its ends. The cone-shaped openings 54 do not completely penetrate the cylinder, terminating so as to leave a portion of the cylinder coaxially attached to the rod 50. The intersection 56 between the rod 50 and the portion of the cylinder 52 establishes the frequency at which an ac current passing through the ends of the rod 50 can be expected to pass primarily through the rod 50 or through the surface of the cylinder 52. AC signals having a frequency such that the intersection 56 is greater than $2_{\delta s}$ will tend to follow the surface of the cylinder (and experience the greater length resistance path).

With continued reference to FIGS. 5 and 6, the openings in the cylinder do not have to follow the shape of a cone and, as previously indicated with other embodiments, the surface may be roughened to increase the resistance experienced by the various currents passing therethrough. The shape of the path experienced by the currents passing near the surface may be any arbitrary shape, one of the objects of the present invention being to increase the path length for certain frequency signals. The shape of the additional surface area experienced by these signals can be regular or irregular, conic or non-conic, so long as a separate and different length path is provided for some signals.

While the present application speaks in terms of paths for electrical signals, it should be understood that such discussion is meant for purpose of illustration only. As noted above, electrical current will travel across the entirety of an element; however, the gradient of the current will be much stronger near a surface or near an interior depending upon the frequency of the signal, and the shape and type of materials being used to form the resistive elements. Thus, it should be understood that asserting that the current flows primarily near the surface in some aspects of the present invention does not preclude some of the current from flowing at the center of the device and vice versa. In the above-noted examples, the invention was discussed with reference to electrical currents traveling within one skin depth of the surface of the element. The invention is not limited to devices in which most of the current travels within one skin depth of the surface. It is well known that most of the skin effect current travels within one to three skin depths of the surface and the present invention contemplates such different depths as being within its scope.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. An electrical resistor comprising a disk of resistive material wherein a portion of the top and bottom surfaces of said disk are concentrically notched so that electrical signals having a frequency below a predetermined frequency travel from one portion of the edge of the disk to another portion of the edge of the disk primarily through the unnotched portions of the disk and electrical signals having a frequency above said predetermined frequency travel between said edge portions primarily through the notched portions of the disk.

2. The electrical resistor of claim 1 further comprising plural means for connecting electrical signals to said disk.

3. The electrical resistor of claim 2 wherein said plural means are spaced apart from one another along the lateral edge of the disk.

4. The electrical resistor of claim 3 wherein said plural means are spaced approximately 180 degrees apart along the lateral edge of said disk.

5. The electrical resistor of claim 4 wherein said plural means include terminals along the lateral edge of said disk for facile connection to an electrical conductor carrying an AC signal.

6. The electrical resistor of claim 1 wherein said disk is a unitary structure.

7. The electrical resistor of claim 1 wherein the notched portions of said disk are made of a material different from the material in the unnotched portion of said disk.

8. The electrical resistor of claim 1 wherein the notched portions of said disk are roughened in a regular fashion.

9. The electrical resistor of claim 1 wherein the notched portions of said disk are roughened in a random fashion.

* * * * *